US008052859B2

(12) United States Patent
Schneller

(10) Patent No.: US 8,052,859 B2
(45) Date of Patent: Nov. 8, 2011

(54) ALUMINUM PRODUCTION PROCESS CONTROL

(76) Inventor: Michael Schneller, Istanbul (TR)

( * ) Notice: Subject to any disclaimer, the term of this patent is extended or adjusted under 35 U.S.C. 154(b) by 222 days.

(21) Appl. No.: 12/515,568

(22) PCT Filed: Dec. 18, 2007

(86) PCT No.: PCT/US2007/087883

§ 371 (c)(1),
(2), (4) Date: May 20, 2009

(87) PCT Pub. No.: WO2008/077016

PCT Pub. Date: Jun. 26, 2008

(65) Prior Publication Data

US 2010/0065435 A1 Mar. 18, 2010

Related U.S. Application Data

(60) Provisional application No. 60/870,708, filed on Dec. 19, 2006.

(51) Int. Cl.
*C25C 3/20* (2006.01)

(52) U.S. Cl. ..... 205/392; 205/396; 205/372; 205/375; 205/390; 205/395; 205/336

(58) Field of Classification Search ..... 205/372, 205/375, 390, 392, 394, 395, 396, 336
See application file for complete search history.

(56) References Cited

U.S. PATENT DOCUMENTS

| | | | | |
|---|---|---|---|---|
| 3,400,062 | A | 9/1968 | Bruno et al. | |
| 3,573,179 | A | 3/1971 | Dirth et al. | |
| 3,625,842 | A | 12/1971 | Bristol et al. | |
| 3,660,256 | A | 5/1972 | Lippitt et al. | |
| 3,712,857 | A | 1/1973 | Piller | |
| 3,812,024 | A | 5/1974 | Goodnow et al. | |
| 4,126,525 | A | 11/1978 | Wakaizumi et al. | |
| 4,425,201 | A | 1/1984 | Wilson et al. | |
| 4,654,129 | A | 3/1987 | Leroy | |
| 4,654,130 | A * | 3/1987 | Tabereaux et al. | 205/336 |
| 4,814,050 | A | 3/1989 | McGraw et al. | |
| 5,089,093 | A * | 2/1992 | Blatch et al. | 205/336 |
| 5,362,366 | A * | 11/1994 | de Nora et al. | 205/375 |
| 5,476,574 | A | 12/1995 | Welch et al. | |
| 6,136,177 | A | 10/2000 | Hung | |
| 6,866,767 | B2 | 3/2005 | Santerre et al. | |

FOREIGN PATENT DOCUMENTS

| | | |
|---|---|---|
| FR | 1457746 A | 11/1966 |
| FR | 1506463 A | 12/1967 |
| JP | 52-28417 | 3/1977 |

OTHER PUBLICATIONS

Final Technical Report: Intelligent Potroom Operation; J. Berkow and L. Banta; Jul. 29, 2003; 34 pages.
Modeling of an Aluminum Reduction Cell for the Development of a State Estimator; P. Biedler; Ph.D Dissertation, University of West Virginia; 2003; 183 pages.
An Advanced Data Acquisition System & Noise Analysis on the Aluminum Reduction Process; C. Dai; M.S. Thesis, University of West Virginia; 2003; 91 pages.
Report of the American Society of Mechanical Engineers' Technical Working Group on Inert Anode Technologies; Jul. 1999; 180 pages.
Low-Temperature Reduction of Alumina Using Fluorine-Containing Ionic Liquids; Industrial Technologies Program; U. S. Department of Energy; May 2006; 2 pages.
Microwave-Assisted Electrolytic Cell; Aluminum Project Fact Sheet; U.S. Department of Energy; Mar. 2003; 2 pages.
Conception des Tourillons d'anode en Usage Dans Une Cuve de Hall-Heroult a l'aide de la Methode des Elements Finis; D. Richard; Master's thesis, Universite Laval; May 2000; 117 pages.
International Search Report and Written Opinion; PCT/US07/87883; Apr. 29, 2008; 8 pages.

* cited by examiner

*Primary Examiner* — Bruce Bell
(74) *Attorney, Agent, or Firm* — Brown & Michaels, PC

(57) ABSTRACT

The method of process control is for a Hall-Héroult process of aluminum production from alumina ore in an industrial pot-line. The method includes measuring an array of sampled potline data including a plurality of cell voltages (V) and a plurality of line amperages (A) at a plurality of time points. The method also includes calculating a predicted voltage (PV) for each cell voltage and line amperage in the array. The method further includes controlling a plurality of alumina ore feed rates and a plurality of pot voltage settings based upon the predicted voltages. The method also includes calculating a plurality of bath temperatures based upon the predicted voltages. The PV variable is preferably used in an automated control environment. The PV variable is also preferably used to monitor cell noise levels, operating temperature, metal pad roll, and oscillatory electrical shorting events.

14 Claims, 9 Drawing Sheets

ALUMINUM PRODUCTION PROCESS CONTROL

REFERENCE TO RELATED APPLICATIONS

This application claims one or more inventions which were disclosed in Provisional Application No. 60/870,708, filed Dec. 19, 2006, entitled "ALUMINUM PRODUCTION PROCESS CONTROL". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of the industrial electrolytic production of aluminum. More particularly, the invention pertains to the automated control by process variables in the Hall-Héroult method of primary aluminum production.

2. Description of Related Art

The production of primary aluminum metal is a highly energy-intensive industry. A substantial portion of the cost of aluminum production is in the enormous amount of electrical energy required. Increasing energy costs and increasing requirements for low levels of polluting emissions place increasing demands on the primary aluminum production industry. There is therefore always a need for methods that improve the energy efficiency of the aluminum production process and decrease fluoride emissions, including greenhouse perfluorocarbons (PFCs). The Hall-Héroult process for primary aluminum production, which is used by all major industrial aluminum producers, utilizes direct electrical current passing through a molten chemically-modified cryolite electrolyte, or "bath", to produce aluminum metal from alumina ($Al_2O_3$). In the process, the alumina is dissolved in an electrolyte composed primarily of molten cryolite ($Na_3AlF_6$) and other additives such as excess aluminum fluoride ($AlF_3$) and calcium fluoride ($CaF_2$) at temperatures above 900° C. As current is passed through the electrolyte, aluminum metal is deposited at the molten aluminum cathode, and oxygen evolves at the surface of a solid carbon anode and combines with the carbon to produce mostly carbon dioxide and lesser amounts of carbon monoxide gas. The dissolved alumina in the electrolytic cells, or "pots", is depleted in direct proportion to the amount of aluminum metal produced.

The concentration of alumina in the electrolytic bath is of critical importance to the efficiency of the aluminum production process. As the alumina concentration in the electrolytic bath decreases, a point is reached where a phenomenon known as an "anode effect" occurs, typically in the concentration range of 1.5% to 2% alumina. When an anode effect occurs, the voltage drop across the cell, which is normally between about 4 to 4.5 volts, may rise very rapidly to a level of about 15-30 volts. The actual concentration of alumina in the electrolyte at the onset of this effect depends upon the critical anode current density. Other variables, such as temperature and composition of the electrolyte, also play a role, but anode effects usually occur at an alumina concentration below about 2% by weight of the electrolyte. A cell in the anode effect state becomes less productive and consumes a large amount of power, thus seriously compromising the efficiency of the process. Additionally, during anode effects, the cryolite electrolyte enters into chemical reactions at the anode leading to the production of gaseous fluorinated products including perfluorocarbons (PFCs) and hydrogen fluoride (HF). The emission of PFCs has become a point of concern since PFCs have thousands of times more infrared radiative capture capacity than $CO_2$. Hydrogen fluoride (HF) releases to the environment are especially deleterious to plant life. The release of greenhouse PFCs and HF to the atmosphere is becoming increasingly restricted by environmental legislation.

Although the anode effect presents serious problems in the control of aluminum reduction cells, this phenomenon is generally a less serious commercial problem than the overfeeding of alumina to the cell. A cell with a continuing excess of added alumina may enter an operational stage commonly termed a "sick pot" or "sick cell." The upper practical limit for alumina concentration for operation is approximately 4%, above which alumina no longer dissolves sufficiently fast. The ideal operational concentration and solubility of alumina in the bath therefore falls within a narrow window of about 2-4% alumina. If a cell is overfed, all of the alumina does not immediately dissolve in the electrolyte and a fraction of it therefore tends to settle at the top of the metal cathode or at the bottom of the cell, thereby seriously increasing a cell's electrical resistance and promoting non-uniform current distribution. These effects also decrease a cell's cathode life. Undissolved alumina that settles to the bottom of a cell is called cathode "sludge" or "muck" and is difficult to remove quickly by the dissolution process. Additionally, residual un-dissolved alumina muck on the bottom carbon cathode surface promotes erosive effects, since the alumina itself is extremely abrasive and scours the carbon cathode surface due to the motion of alumina particles by the magneto-hydrodynamics of the metal pad. Hence cathode life is significantly reduced. This necessitates capital expenditures for rebuilding the cathode shell after it fails. During a failure episode, iron levels may rise either gradually or sharply, thereby degrading the quality of the aluminum produced during the remaining shortened life of the cathode. While it may take a short period, on the order of one to ten minutes, to extinguish an anode effect, an overfed cell takes considerably longer time to allow carbon cathode muck levels to be decreased. Thus it is has been usual industrial practice to operate as much as practical nearer the lower part of the operational alumina concentration range to specifically avoid the problems of cathode sludge or muck. Indeed, many automated control strategies have in the past attempted to promote at least one anode effect about every day or so, specifically to prevent the overfeeding of alumina ore to the cell. However, in light of the increased sensitivity to the atmospheric release of un-capturable perfluorocarbons (PFCs), which accompanies anode effects, as well as the metal production decrease, this strategy needed to be replaced to conform with more stringent environmental laws and to address the increased cost of electrical power.

Ideally, to maintain optimal production efficiency, the concentration of dissolved alumina is preferably held at moderate levels as much as possible by adding alumina at the same rate it is being consumed in a cell. Unfortunately this is not always possible to achieve due to the physical characteristics of the pots and the difficulty of accurately monitoring the actual in situ concentration of dissolved alumina in the electrolyte bath on a continuous real time basis. In practice, the voltage drop across each cell and the current passing through the potline are used to compute a pseudo-resistance (PR) variable to estimate the state of the cells and the need for the addition of alumina and changes in pot voltage. Cell voltage changes are achieved by controlling the distance between the carbon anode surface and the aluminum cathode surface (anode/cathode gap). The cells in a commercial aluminum production plant are connected in electrical DC series and most often number a hundred or more (referred to collectively as a potline). The measured raw data that is sampled by a computer or microprocessor to assess the status of the individual pots is typically limited to the voltage drops (V) across the individual cells and the simultaneous amperage through the potline (A). Extrapolating from these measured parameters to calculate the dissolved alumina level on a real time basis is a goal of great practical interest and is a complex problem that has been the subject of much research. Each cell behaves differently at a given moment as a result of differences in numerous factors including the bath alumina level and its rate of change, the age of the cell, the electrolyte composition, the anode-cathode distance, the condition of the anodes and cathodes, and the operating temperature. Thus the relationship between changes in the current-voltage profile and the dissolved alumina level may be somewhat different for each cell in a potline. This situation is further complicated by a number of factors which affect the operating current and voltage of the cells. As a result of the interdependence of a large number of cells in a potline, the potline amperage generally fluctuates to a greater or lesser degree because of changes occurring in one or more cells at any given instant, including occasional power changes in the rectifier. Cells in a potline typically experience voltage changes from two primary sources: the internal changing levels of alumina (assuming other bath variables do not change significantly in a short time period) and the external fluctuating potline amperages. Cell voltage changes over several seconds or more are affected mostly by fluctuating potline amperages and not the subtle voltages from very small changes in bath alumina levels, when these levels are not so low that an anode effect is pending within a minute or so. Amperage levels may also fluctuate whenever power loads in the rectifier change.

In present practice, a cell's voltage/amperage data is sampled over time and processed to yield a variable known as pseudo-resistance (PR) that attempts to factor out voltage changes from external fluctuating potline amperages, while retaining the changes indicative of the cell's alumina level (see e.g. Dirth et al., U.S. Pat. No. 3,573,179).

The definition of a cell's pseudo-resistance value is:

$$PR=(V-I)/A \quad (1)$$

where

V=cell voltage at a given instant

A=line amperage at the same instant

I=the extrapolated cell voltage at zero amps (an estimated and generally inaccurate value is arbitrarily chosen)

Processes for automated alumina feed, using feedback from measured pot voltage and line amperage parameters from the electrolytic cells, have been described in the following patents: French patent FR 1 457 746, in which the variation of the internal pseudo-resistance of the cell is used as the key parameter reflecting the concentration of alumina, and French patent FR 1 506 463, in which control is based on measurement of the time elapsing between halting the alumina supply and the appearance of an anode effect. More recently, a process based on controlling the alumina content has been described in particular by Wakaizumi et al. (U.S. Pat. No. 4,126,525).

In addition to attempted efforts to achieve accurate control of the alumina concentration in the cells, it is common practice to automate the control of the anode-cathode distance or gap to optimize cell voltage levels. Adjustments are typically made by raising or lowering the carbon anodes in the bath. The anode-cathode distance has a strong effect on what is commonly labeled as pot noise, so this variable is also tied to the pseudo-resistance (PR) process control variable already discussed. If the anode-cathode gap has been either squeezed too much or driven to higher than optimal levels, a PR sourced calculated noise level is used to make a statistically derived anode/cathode adjustment to the cell to maintain thermal balance in order to reduce the loss in production efficiencies that can occur if high temperature excursions are encountered.

A Hall-Héroult electrolytic cell is not a classic resistor. Hence the relationship between cell voltage and cell current is not, strictly speaking, linear over the entire amperage range with a zero/zero intercept. In an operating potline, the amperage fluctuates to some degree about an average operating level which is never anywhere near an amperage of zero. In potline practice the relationship between voltage and amperage is most often a linear one for all practical purposes. A cell's total impedance does include classic ohmic resistances including the electrical connectors, anode and cathode bus conductors, carbon anode drop, cathode drop, and the cell's intrinsic electrolytic resistivity, anode gas bubble resistance, and an ohmic component of the electrolytic bath itself. The voltage drop across the anode-cathode gap, where there is a small separation between the two electrodes, includes components that are not ohmic in nature. They generally include cathode-anode over-voltages (dependent upon alumina level, bath ratio, and temperature) and a back electromotive force (emf) value which is not the same as the extrapolated intercept value (I) of the operating voltage/amperage linear relationship. Direct measurement of the back emf necessitates lowering the amperage to almost zero values, which is neither practical nor useful for an operating potline, especially since the voltage/amperage is not linear over the entire range starting at zero amps. The alumina concentration over-voltages at operating potline amperages may vary rapidly in a relatively short time period, since alumina concentration changes quickly if alumina consumption is not compensated by the correct and commensurate amount of alumina feed. However, the rate of increase of the over-voltage component due to decreasing changes in the alumina concentration may be on the order of magnitude of a few millivolts per minute, which is very daunting to nearly impossible for the PR variable to confidently predict in the short time period of several minutes. This required sensitivity is simply not within the grasp of the PR variable. There is therefore an ongoing and pressing need for an accurate in situ method which is capable of accurately estimating in a short time period the amount of alumina dissolved in the electrolyte of a given cell and which is also relatively impervious to the noise and complications created by interference from changes in other process variables.

A plot of a cell's voltage (V) versus potline amperage (A) over a short time period is mostly linear with a positive non-zero intercept (I) value that is almost impossible to accurately measure in a practical way at any given moment. The slope of this line is another way to describe the PR variable. It seems that the choice of the PR variable as the control variable was the logical one, when automated control was first instituted because the linear relationship of V and A was so obvious to everyone. Thus it may have happened that the choice for using another control variable less subject to intrinsic error was overlooked, since the slope (i.e. PR) relationship between voltage and amperage was so obvious. There is a general agreement that the use of the term pseudo-resistance is an appropriate one for the slope of this relationship. PR is not a true resistance value even though it often incorrectly appears in the literature bearing units of micro-ohms. It is well known that different combinations of bath variables and anode/cathode gaps produce different linear relationships of voltage versus amperage. This has been shown to be true from many years of experience using the PR variable in potline control since the advent of process computer control decades ago. It became generally obvious from the beginning of the automated control period that there would be utility in calculating a slope value (PR) for a given voltage/amperage data point to obtain a hopefully useful predictor of the state of a cell, as potline amperages varied for reasons pointed out previously. It seemed reasonable and prudent to select the obvious pseudo-resistance (PR) value as a control variable in potline automated control at that time, since the linear voltage relationship was so well known in all quarters. The PR variable was adopted throughout the industry as a first step in describing the state of the cell as voltage/amperage data is sampled from cells in a potline. The PR variable is still very widely, if not exclusively, used for process control in modern aluminum smelters.

Downstream processing of the PR variable to obtain a better image of the state of a pot and what changes may be taking place on a real time basis is common practice and takes many forms. These innovations have taken on sophisticated roles and have been used for improving aluminum process control over the years and have resulted in significant cell voltage reductions and alumina feed control improvements. The industry has made large strides in reducing unit energy consumption as well as environmental fluoride emissions using these methods, but there is a never ending need in the art for further progress.

SUMMARY OF THE INVENTION

A method for control of Hall-Héroult electrolytic cells using voltage and potline amperage data streams from operating cells in a potline uses a variable known as predicted voltage (PV), which has significant advantages over the currently-used PR control variable. The use of PV as the process control variable significantly improves predictive abilities compared to the commonly employed pseudo-resistance variable (PR). Process control suffers less from self-induced inaccuracy than do the present PR-based control strategies due to the intrinsic uncertainties in the arbitrarily estimated value of the intercept (I). Application of the PV variable in the monitoring of Hall-Héroult electrolytic cells provides information useful for several aspects of process control necessary for more efficient aluminum production and lower environmental emissions. These aspects include accurate estimation of in situ dissolved alumina levels, measurement of a pot's in situ operating temperature, and voltage optimization through more statistically significant noise level computations employing Lomb style signal processing to provide a sound statistically significant basis for the control of anode-cathode distance including the detection of metal pad roll in the cell and other voltage oscillations such as electrical shorting episodes. These in situ control methods work in concert to increase the efficiency of aluminum production while simultaneously and significantly decreasing pollutant fluoride emissions.

DETAILED DESCRIPTION OF THE INVENTION

Figure 1:
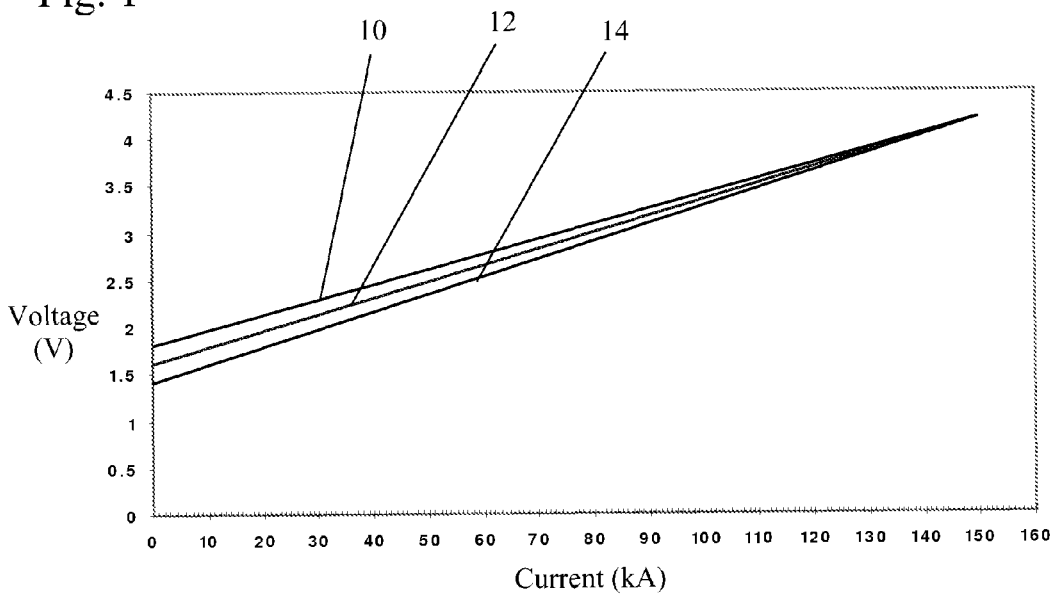
FIG. 1 shows a graph of a single data point for potline amperage (150.0) and cell voltage (4.000) at different values of the intercept (I).

In a method of the present invention, a predicted voltage (PV) variable is calculated from sampled potline data to direct the rate of addition of alumina to a pot and determine whether pot voltage adjustments are desirable. This variable is a much more accurate estimator of in situ alumina concentration and in situ bath temperature than the widely used PR variable. As noted above, a cell's PR value is defined as:

$$PR=(V-I)/A \tag{1}$$

where I is the arbitrarily estimated intercept (voltage at zero current) of the voltage/amperage linear relationship and is generally treated as a constant. By definition I is an extrapolated value whose accurate experimental determination is not possible in a practical way in an operating potline. An arbitrary value is therefore chosen and the variable is henceforth treated as a constant, which of course is not in accord with the reality of the situation. The value of this chosen constant often varies from cell type to cell type, but most often a value somewhere in the range 1.4 to 1.8 is used. There is a very serious drawback to choosing an estimated and constant value of I for calculations producing pseudo-resistance variables. Regardless of the rationale employed, there is a significant statistical error associated with any choice made in the estimate of I. Compounding this difficulty is the fact that the actual value of I changes as the electrolytic state of the pot changes over time. Therefore the difference between the value assigned to I and the actual value of I in an operating cell also changes over time. The combination of these variations makes any working choice of I an arbitrary one. A close inspection of calculated pseudo-resistance values from sampled data from an operating potline reveals fluctuations in pseudo-resistance computations over short time periods that simply cannot be reflective of actual changes in a cell. A data point containing a cell's voltage (V) and line amperage (A), when processed into a PR value using an estimated value for I has large inherent error as will be demonstrated. Errors in the estimate for I produce relatively large intrinsic errors in the computed PR value. A linear regression of measured voltage versus amperage with a confidence interval at a given level of significance surrounding the regression line is an informative exercise. There is a large uncertainty or intrinsic error that I possesses as an extrapolated value of a cell's voltage at zero amps. It is a large extrapolation since an operating potline is always far from zero amps (typically in the hundreds of thousands of amps).

The choice of PR as a control variable necessitates picking an assumed value for I and using it as a constant to obtain the working variable PR. It has been amply demonstrated by much experience over the years that there is usefulness in employing the PR variable in potline control. There remains, however, additional room for improvement since the PR variable is not as robust or error free as may have been hoped for, especially in lights of the advantages of using the PV variable as described herein. Digital filtering techniques employed to "settle down" the highly fluctuating PR variable may also undesirably dampen the real signal itself and significantly decrease the likelihood of detecting the subtle voltage changes reflective of in situ bath alumina level conditions and bath operating temperatures during short time spans.

Many smelters now employ the well-known technique of point feeding using variations of an overfeed/underfeed cycle coupled with an estimated normal feed period based upon PR computations ("resistance tracking") to regulate bath alumina levels to avoid undesirable anode effects and cathode mucking episodes (see, for example, U.S. Pat. No. 6,866,767 and U.S. Pat. No. 5,089,093). If a more accurate method of estimating in situ alumina levels were available, then it would be possible to significantly improve the control of alumina ore feed to avoid operating at low levels of bath alumina, where anode effects and higher bath temperatures are likely to occur, and moving too close to high levels of bath alumina, where production of un-dissolved alumina ore and/or bath ore conglomerates can settle and deposit for a time on the metal cathode surface, creating a less productive cell (or worse yet producing bottom cathode sludge or muck). These are unavoidable events that regularly occur in a feed cycle dependent upon the error laden PR-based control.

The optimization of cell voltage is employed by various means to reduce pot voltage set points whenever a cell is judged stable (noise free) enough to warrant the risk of decreasing the anode/cathode gap. A poor decision to reposition the anode downward can produce waves (rolling) in the molten aluminum metal accumulated on the cathode metal pad and other deleterious voltage oscillations due to electrical shorting, etc. Electrical shorting of any kind produces heat at the expense of metal. An increased roll in the metal pad can then increase the rate of re-oxidation of metal, producing a decrease in current efficiency as well as causing high temperature excursions and thereby upsetting the heat balance of the cell. This is always an attendant risk whenever pot voltages are decreased. Increasing pot voltage when no voltage cycling is detected may also be unwarranted, since higher temperatures and lower productivity results from increasing the ohmic component of cell voltage. Higher temperatures result in lower current efficiency. For each pot there is an optimal pot voltage level that changes constantly, however, within the metal tapping and carbon setting cycles. At present a cell is judged stable or "non-noisy" when PR has a relatively low level of variability in a short time span. When such a condition is detected, a cell's voltage is cautiously lowered. If a cell is judged "noisy" because of a high variance (or related statistical variable) in pseudo-resistance calculations, then pot voltage is increased because of potentially harmful effects due to increased metal pad roll or electrical shorting events induced by a non-uniform anode surface such as inaccurate carbon sets, etc.

PR computations have significant levels of self-induced noise, due in large part to the large amount of intrinsic error embedded in the arbitrary choice made for the selection of I. This error is a mathematical artifact and significantly interferes with the PR-derived picture of the true state of a cell. This meaninglessly increased background "noise" in PR computations obscures to a large extent the real pseudo-resistance signal itself and renders the decision-making process more risky, i.e. where cell voltage could be lowered and is not lowered, where cell voltage is lowered and should not be lowered, where cell voltage should be increased and is not increased, or where cell voltage is increased and should not be increased. Also, too much or too little alumina ore is often fed to the cell because PR is not sensitive to small, but real, changes in actual bath alumina levels. As a result, present PR-based methods of alumina feed control unavoidably cycle too much by the over and under feeding of alumina and the consequent cycles of cathode mucking and excess heating that occur. Nearing the extremes of operational alumina solubility are the only times when PR-based methods of alumina feed control are able to reliable determine that corrective action is needed. A PV-based approach to cell control avoids these extremes and provides a more statistically sound scheme to significantly reduce the number of faulty pot voltage and alumina ore feed decisions, which is therefore beneficial for both the production process and environmental performance.

It is reasonable to expect that solely using the measured cell voltage as the key control variable would work well if the line amperage were truly a non-fluctuating constant. In such a situation there would be no need to calculate the pseudo-resistance (PR) or the predicted voltage (PV) variable. Under such a condition the control variable would simply be the measured cell voltage itself. This is a key concept for the practical use of the predicted voltage (PV) variable explained below.

FIG. 1 shows pot voltage versus line amperage of a single data point for intercepts I of 1.8 (10), 1.6 (12), and 1.4 (14). A visual inspection of FIG. 1, where a single data point consisting of a potline amperage of 150.0 and a cell voltage of 4.200 is plotted with different possible intercepts, demonstrates the inherent error in the PR variable. This graph clearly demonstrates the assertion that PR is a computation with mathematically-induced error. Any change in the chosen value of the intercept (I) causes a significant change in the slope value, or pseudo-resistance (PR). However a calculated value of an expected or predicted pot voltage at a constant reference amperage near 150, for example, produces a much smaller relative variation in that signal as opposed to the relatively larger changes that occur with the pseudo-resistance slope-based calculation. The three plots in FIG. 1 converge near a voltage with almost no variation. The predicted voltage (PV) is extremely close to this convergence.

There is a simple remedy to address the reality of fluctuating potline amperages that produce varying pot voltages by employing a variable that predicts what the cell voltage would be if the line amperage were not fluctuating. It is called the predicted voltage (PV) variable and takes on a recognizably simple form:

$$PV=[(V-I)/A]\times RLA+I=PR\times RLA+I \quad (2)$$

where V, A, PR, and I are as previously defined and

RLA=constant reference line amperage

The value of the RLA variable is chosen to be the targeted average operating line amperage. The present invention concerns the practical application of this mathematical expression of the predicted voltage (PV) variable to the control of Hall-Héroult cells in aluminum production in order to overcome the limitations/shortcomings inherent in using the PR variable as discussed above. Monitoring a cell employing the PV variable provides a significant improvement in potline control. The predicted voltage calculation is especially insensitive to unknown and potentially large uncertainties or errors in the estimate of I as can be shown using the following simple example with a "true" value of I=1.600, but the working value of 1.450 substituted instead since a true value is impossible to determine in an operating potline:

Sampled data point V=4.200 volt and A=150.0 kA (assume perfect resolution)

RLA=152.0 kA (a constant generally close to sampled amperage)

True $PR\times10^3$=17.33 v/kiloamp and true PV=4.235 v ("true" I=1.600)

Calculated $PR\times10^3$=18.33 and PV=4.237 (working value of I=1.450)

PR % error=5.77 and PV % error=0.047

It is clear from the above simple exercise that almost no error occurs in PV even when more than 100 times as much comparative error results for the PR variable simply on the basis of the choice made for the value of I alone.

As potline amperage stabilizes and approaches a constant (RLA), the relative error in the computed value of PV approaches zero, unlike the PR variable whose inherent error never approaches zero at any amperage. A simple manipulation of PV as defined previously produces the following expression:

$$PV=V(RLA/A)+I(1-RLA/A) \quad (3)$$

as A→RLA, then RLA/A→1 and PV→V

If there are large errors in the arbitrarily chosen value of I, as there certainly must often be, then the error in the calculation for PV is effectively cancelled out as A approaches RLA. In practical terms there is almost no I-induced error in PV computations.

A special case of PV occurs when the potline amperage A is always the same as the RLA. Under this circumstance no calculation is necessary. The measured pot voltage itself becomes the process control variable. This special case of the predicted voltage is a condition when potline amperage does not vary. Under these circumstances (A=RLA) the PV process control variable is equal to the measured cell voltage V. If stable line amperages were possible, the measured cell voltage would become the logical control variable of choice, and no PV computations would in essence be needed since PV and pot voltage V merge into the same value.

As another example to illustrate the difference between the PR variable and the PV variable, a simulated potline data array was used for calculations of PR and PV for a cell with no impressed random error in the value of I, ("true" PR=17.33×$10^{-3}$ volts/kiloamps, "true" PV=4.200 volts, "true" I=1.600 volts, and RLA=150.0 kiloamps). In an embodiment of the present invention, the idealized data set in Table 1 below, however, had randomized ±0.10% errors impressed upon both idealized V and A values (real measuring devises do not possess perfect resolution), but no errors impressed upon the "true" value of I=1.60. The following data simulates a snapshot of an operating pot in a very short time interval when no bath alumina level change occurred and no voltage oscillations were present. A plot of the data in Table 1 is presented in FIG. 2.

TABLE 1

| Kiloamps (A) | Voltage (V) |
|---|---|
| 150.95023 | 4.216984023 |
| 150.91958 | 4.214200123 |
| 150.75629 | 4.213693713 |
| 150.79418 | 4.209561933 |
| 150.48827 | 4.205841657 |
| 150.48391 | 4.206323897 |
| 150.31956 | 4.200627327 |
| 150.06196 | 4.205070277 |
| 149.97134 | 4.199480727 |
| 149.81955 | 4.195110777 |
| 149.71609 | 4.198137983 |
| 149.93473 | 4.200000773 |
| 149.35224 | 4.195217593 |
| 149.49543 | 4.194678923 |
| 149.15885 | 4.18743335 |
| 149.06912 | 4.18135001 |
| 148.85346 | 4.183902267 |
| 149.13001 | 4.182475987 |

Figure 2:
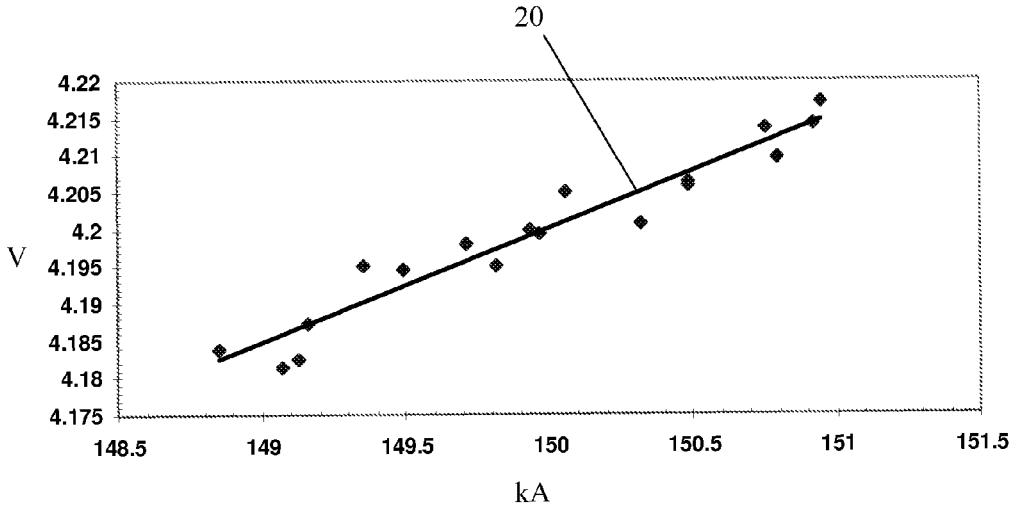
FIG. 2 shows a plot of simulated potline data having randomized 0.10% errors impressed only upon V and A.

FIG. 2 shows the best fit of the data of Table 1 to a straight line (20). The straight line satisfies the equation: pot voltage=0.0153703×amperage+1.89453 with an $R^2$ value of 0.9309. Inspection of FIG. 2 produces key insights. The extrapolated intercept value produces 1.895 and differs considerably from the "true" value of 1.600 impressed upon the data set with small randomized errors impressed upon V and A only. Multiplying the slope by 1000 produces a value of 15.37, which also differs considerably from the "true" PR value of 17.33 (an 11.3% error). Most telling is the regression intercept of 1.895 when compared to the impressed "true" value of I=1.600. There is no reasonable and practical means at hand to establish with reliable confidence an accurate value of I in an operating potline. This in turn leads to large uncertainties in the calculation of PR values, but not so for computed PV values.

Figure 3:
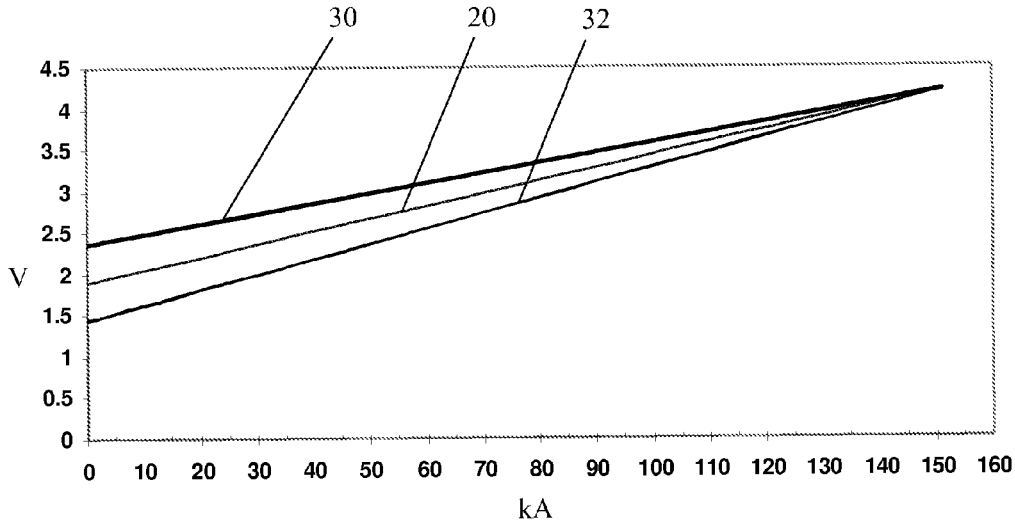
FIG. 3 shows plotted simulated potline data with a 95% confidence interval demarcated to illustrate the effect of estimating the intercept I.

The confidence interval or band about a line of regression is not uniform and broadens out significantly as other points not included in the data set are considered. The confidence interval enlarges quickly as the regression line moves out of the range of the actual data points. Standard statistical methods were applied to the estimate of the error in the intercept (I) value for the above data. FIG. 3 shows the 90% confidence interval (30,32) for the linear regression line (20) from FIG. 2. The graphed data of FIG. 3 very clearly show that the estimated value for I is different from the "true" value of 1.60. The 90% confidence interval demarcates that the true value of I lies within the range 1.44-2.35 (the "true" intercept value for the ideal data set is 1.60). It is clear that any estimate of I is a very approximate one at best. This estimate induces a large uncertainty in any calculation of PR, but almost none for PV. It is recognized that sampling a larger number of data points in the same time period shrinks the confidence interval for the estimate of I. However, that is not a practical approach, especially since the actual value of I at any given moment very well may be changing in time for a host of reasons. Also, a data set with little dispersion in amperages may produce estimations of I with especially low credibility. In contrast, the confidence interval for the individual prediction of the PV variable at RLA=150 is extremely narrow (PV=4.2000±0.00294 volts) with an estimated error of ±0.07%.

In an operating potline the arbitrary value chosen for I possesses much uncertainty at all times. As a result, the calculated pseudo-resistance value (PR) may be far from the "true" value. If I were to not change at all, then there would be a degree, at least, of consistent sensitivity of changing PR values to actual changes in bath variables. However, that simply is not a realistic expectation in a real potline. As the variable I does change over time, it would be extremely difficult, if not impossible, to accurately determine what the new and accurate value for I would be at any given moment. It is just not statistically possible to ferret out an accurate value of I in a practical way in an operating potline with a hundred or more cells. The true value of I, whatever that may be, can be considered a very elusive prey, but one not worth the pursuit since the use of the PV variable as the control variable avoids this statistical quagmire.

Relying on an estimated value of I is a risky but unavoidable choice if PR calculations are used to predict the state of a cell. But it is a much less risky choice for PV calculations. It is generally considered statistically safe to interpolate within a data set, but it becomes problematic to extrapolate values outside of the data set itself. Extrapolating a value of pot voltage at zero amps (i.e. an I value) when the actual data set contains amperages very far from zero will not by any means produce accurate PR computations. Importantly, PV is an interpolated value, not an extrapolated one. This establishes much more credibility for interpolation-based PV values than extrapolation-based PR values. Also of note is that PR properly speaking does not have the physical unit of ohms attached to it, but is rather a ratio of v/kA. The use of the unit micro-ohms for PR calculations is incorrect even though it is still seen as such in the literature. On the contrary, PV has a real physical unit attached to it—namely, volts. Using potline data arrays, it is impractical to squeeze the confidence interval for I (which is a moving target in any case) by sampling an extremely large number of data points to improve confidence in the PR-computed value. Substituting the use of the PV variable for PR greatly lessens the effect of errors in I, more so when the operating potline amperage is close to the reference line amperage (RLA), when errors in I are almost totally cancelled out in computations for PV, as explained previously. When the operating potline amperage A is close to the reference line amperage (RLA), PR computations still retain unavoidably large intrinsic errors.

Figure 4:
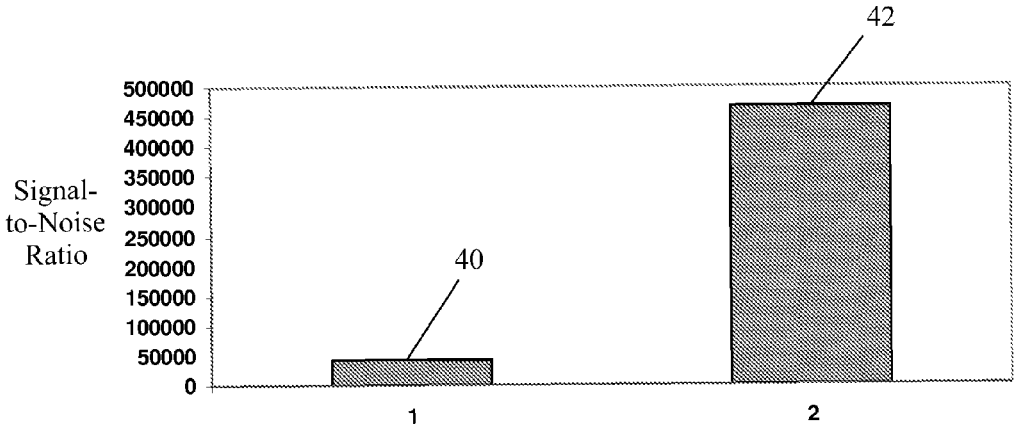
FIG. 4 shows the ratio of the average ($\mu$) to the variance ($\sigma^2$) of PR and PV variables in a data set with impressed 0.10% randomized errors in V and A.

An approach that demonstrates the robustness of the PV variable as opposed to the PR variable is to calculate a statistical variable that is the ratio of the variance to the mean of PR and PV in a data set ($\sigma^2/\mu$). The inverse of this variable ($\mu/\sigma^2$) may be likened in some degree to a signal-to-noise ratio (SNR) and serves as a statistical measure of the randomness in the PR and PV variables. Demonstrated in FIG. 4 is the ratio of the mean or average ($\mu$) of the variable to the variance ($\sigma^2$) of PR (40) and PV (42) in the previous "ideal" data set with impressed 0.10% randomized errors in V and A but now including the working choice of I=1.70 instead of the "true" value of 1.60 (a not unrealistic situation). This now non-ideal data set is one of very short duration when over-voltages, metal pad roll, or electrical shorting do not contribute to the error in either PR (40) or PV (42). One typical result of this comparison by graphical means in FIG. 4 shows a wide gap between the signal-to-noise ratio (SNR) of PR (40) versus PV (42). When genuine potline data is sampled, the signal-to-noise ratio for both PR and PV is expected to decrease because of metal pad instability, electrical shorting, over-voltage changes, and a number of other reasons. As a result of the error levels demonstrated above, the PR value at any given moment may be considered lacking a high degree of credibility, while a given PV value retains a much higher degree of credibility and may be exploited for improved potline control. It should be recognized, of course, that real potline data typically displays a lower SNR than what is represented in the idealized data set generated for the graph in FIG. 4.

An additional comparison of the intrinsic difference between PR and PV may be expressed by total differential analysis, which may be used to compute the expected theoretical minimum and maximum possible errors intrinsic to PR and PV computations. This method reliably predicts the total error (sometimes called propagation of errors). In the following example only errors in V, A, and I are considered.

The general expression for the total differential is:

$$[df(x,y,z,\ldots)]=[(\partial f/\partial x)dx+(\partial f/\partial y)dy+(\partial f/\partial z)dz+\ldots] \quad (4)$$

Applying the total differential to the PR and PV variables produces the following equations.

$$[d(PR)]=[-(V-I)/A^2]dA+[1/A]dV+[-1/A]dI \quad (5)$$

and $$[d(PV)]=[-(V-I)RLA/A^2]dA+[RLA/A]dV+[1-RLA/A]dI \quad (6)$$

In an embodiment of the present invention, the following parameters were used to calculate the total differential for both PR and PV and the subsequent theoretical maximum/minimum % errors for both.

| | |
|---|---|
| dA = ±0.152 | A = 152.00 |
| dV = ±0.004 | V = 4.0000 |
| dI = ±0.3 | I = 1.50 |
| | RLA = 150 |

Figure 5:
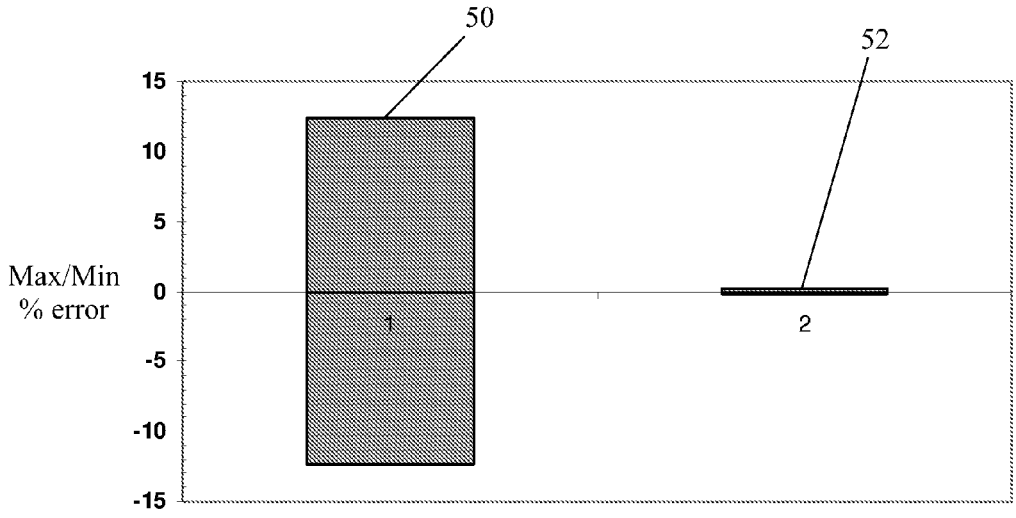
FIG. 5 shows the maximum/minimum errors for the PR and PV variables using the total differential.

The maximum/minimum inherent error thus calculated in PR is ±12.3% versus ±0.26% in PV in this embodiment. This is a dramatic difference in intrinsic error. The total differential partitions the contributions of errors from different sources. It is not surprising that a large contribution to error for PR computations is the inherent or intrinsic error in the intercept I value. Of course the error fluctuates, and for any given data point randomly it may occasionally be zero. A graphical representation of the maximum/minimum errors for the PR variable (50) and the PV variable (52) is shown in FIG. 5.

It becomes readily apparent why feed control based upon pseudo-resistance tracking methods require large excursions into under-feeding and over-feeding alumina ore to achieve the goal of avoiding anode effects and hopefully also avoid over-feeding by a large amount. The time necessary for a statistically reliable change in PR to indicate a real change of in situ bath alumina is large. It therefore is possible for undesirable bath alumina levels to occur. The total differential analysis easily demonstrates the inherent superiority of PV over PR.

Description and Applications of In Situ Bath Alumina Predictions

In an embodiment of the present invention, the demonstrably more accurate PV variable is employed to make in situ bath alumina level predictions for an operating cell with good accuracy. Under these conditions the time rate of change of PV is used to calculate a bath alumina level during a short time period of several minutes when ore feed is shut off and anode movement prevented. It is then possible, with a reliable in situ bath alumina prediction, to adjust alumina ore feed rates (using either a semi-continuous point feed device or a continuous feed mechanism) by small increments to control bath alumina levels within a small margin of the targeted level. The excursions into low and high bath alumina levels that occur with PR tracking methods may be avoided with attendant benefits.

Figure 6:
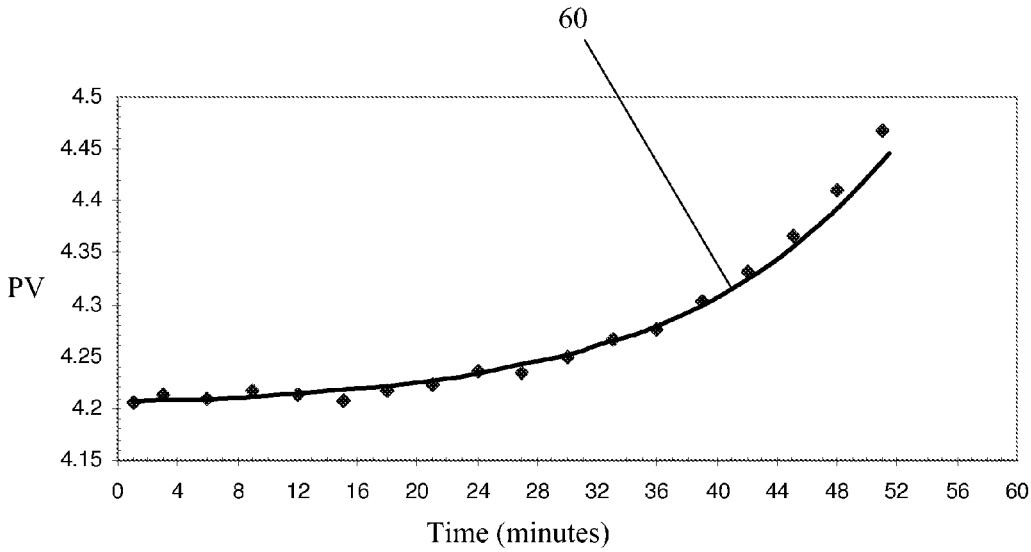
FIG. 6 shows the relationship between PV and time in an embodiment of the present invention.

To calculate an in situ bath alumina level and adjust point feed rates, a set of empirical coefficients is necessary. These coefficients are derived from voltage/amperage signals sampled from a cell when alumina ore feed has been shut off and anode movements prevented for an extended period of time, when the bath alumina level changes in an approximately linear fashion. Since there may be a time delay (hysteresis) between the previous ore feed and the alumina ore charge that subsequently dissolves, it is necessary to delay for a short time the acquisition of data for the determination of in situ alumina bath coefficients. This exercise needs to be done accurately only a few times to establish the proper set of mathematical coefficients. Infrequent re-checks by this method may be performed, especially when operational parameters such as line amperage target changes are made. Then it would be necessary to establish and validate a new set of in situ feed coefficients. During this exercise multiple bath samples are collected as well as bath temperatures and bath depths at times that are synchronized with the data collection of voltages and amperages on selected cells. Ideally this data set should extend over an appreciable period of time when the alumina change is large. Bath samples are subsequently chemically analyzed for bath ratio, and percent bath alumina by a suitable analytical means. These chemical analyses must be accurately performed. The PV variable is calculated from the sampled voltage/amperage data and plotted against time (a small estimated mathematical correction to PV may be needed if the rates of metal pad increase and the anode carbon burn off are not approximately balanced, as is explained later). An appropriate mathematical curve is selected to fit this relationship. See FIG. 6 as one embodiment of the type of relationship and mathematical curve fit (60) that results. This curve satisfies the equation $PV=4.200+0.003971\times e^{(0.08217\times time\ in\ minutes)}$.

Next a plot of measured % alumina versus time should produce an approximately linear relationship. In this embodiment, FIG. 7 shows percent alumina versus time fit to a line (70) satisfying the equation: % alumina=−0.03377×time in minutes+3.840.

Figure 7:
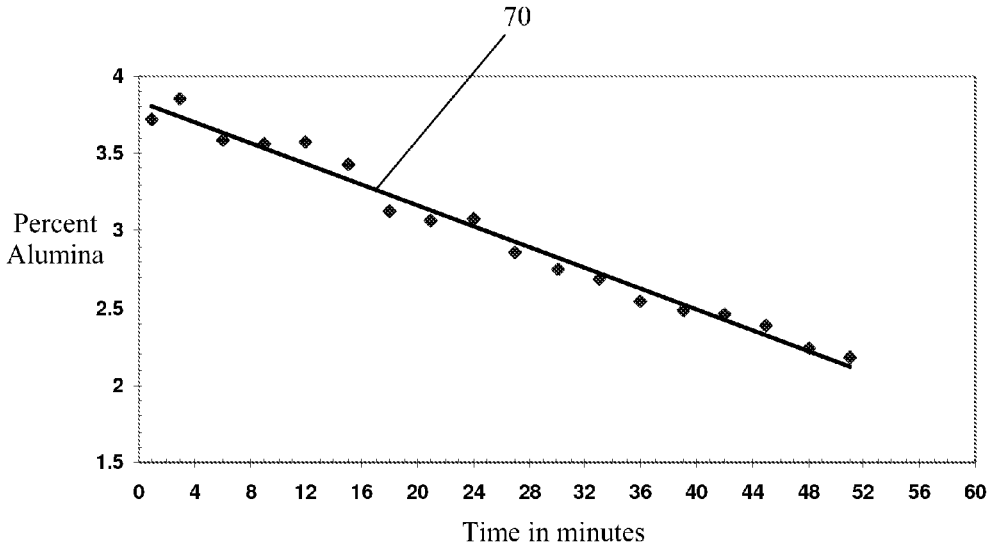
FIG. 7 shows the relationship between measured % alumina and time in an embodiment of the present invention.
Figure 8:
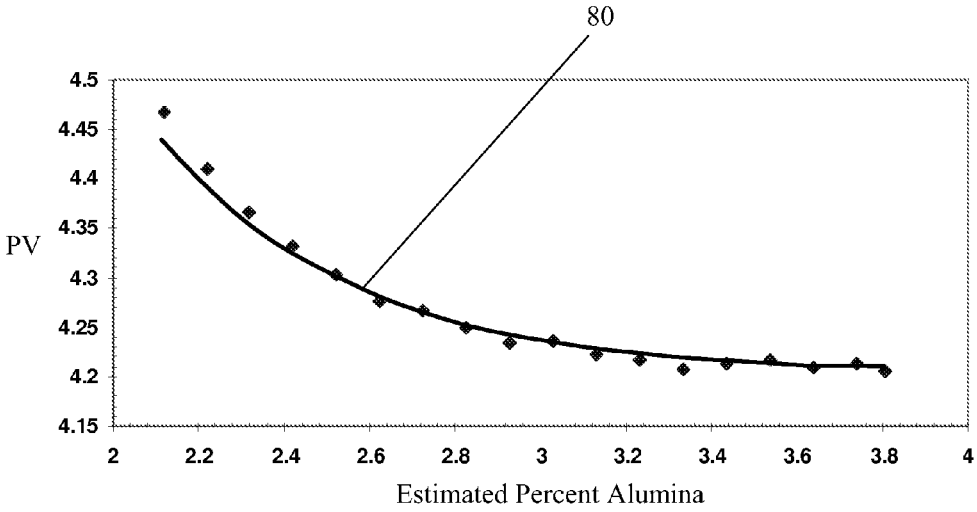
FIG. 8 shows the relationship between PV and estimated % alumina in an embodiment of the present invention.

Using the coefficients of the fitted curve in FIG. 7, estimated values of % alumina are calculated for each data point and a graph of estimated % alumina versus PV with an appropriately fitted mathematical curve (80) is made as shown in FIG. 8. The curve (80) in FIG. 8 satisfies the equation: $PV=4.200+23.15\times e^{(-2.153\times estimated\ \%\ alumina)}$.

Figure 9:
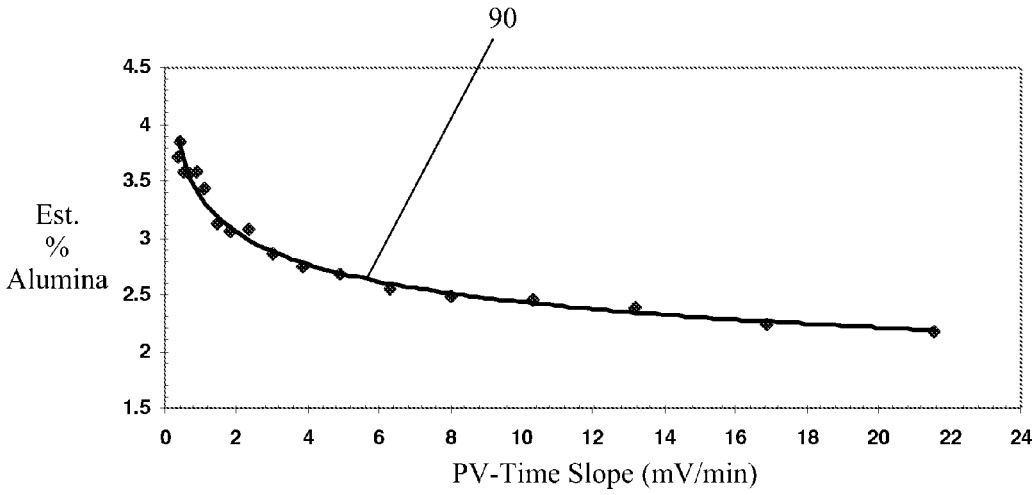
FIG. 9 shows the relationship between estimated % alumina and PV time slope in an embodiment of the present invention.

Another graph is prepared plotting estimated % alumina values (using the coefficients in FIG. 7) versus calculated PV/time slopes (calculated using the coefficients in FIG. 6) for each data point and an appropriate mathematical curve fit (90) is empirically chosen as shown in FIG. 9. The curve (90) satisfies the equation: Estimated % alumina=$3.359\times(PV/time)^{-0.1396}$.

Within the set of parameters characteristic of a given pot, the in situ bath alumina prediction is calculated during the normal operation of a cell using the coefficients of the estimated bath % alumina versus calculated PV/time slope plot (see FIG. 9). During normal operation, whenever an in situ bath alumina level is needed, ore feed is shut off and anode movements are prevented for a short period, preferably several minutes. Voltage and amperage data is collected for several minutes and PV calculated to subsequently compute a PV/time slope (hysteresis necessitates avoiding the use of data collected when alumina from the previous ore feed is still being dissolved). If there is a meaningful difference between the rate of metal pad build up and the anode carbon burn off, then a small mathematical correction is first made to the PV computation. The computed time slope of PV in the data array may be based upon a linear regression of PV versus time (or any other mathematical model that fits the data appropriately). When an in situ % alumina prediction is made using coefficients obtained from the graph in FIG. 9, it is linked to the average PV value of the data set. Next, using the coefficients of the curve in FIG. 8, a PV value is computed for the target % alumina and also for the in situ prediction and then a difference between the two is calculated. This difference is appropriately added or subtracted to the average PV value computed from the data set collected. This procedure establishes a target PV directly linked to the targeted % alumina. Point feed rates are then adjusted during the next several hours to achieve and maintain the targeted PV and its linked % alumina level. This PV target, once achieved by regulating ore feed rates, brings the cell's bath alumina level to the targeted set point within a small margin of error. This PV set point may be used for at least a few hours unless a major interruption occurs such as metal tapping, anode sets, anode effects, or manual intrusions, etc. Whenever this occurs, a new in situ bath alumina measuring routine is called upon, after the temporary upset to normal pot operation is over. If an anode adjustment is made, then the targeted PV is simply recalculated using the difference in PV before and after the anode is adjusted up or down. In this manner the PV variable is accurately tracking the in situ bath alumina for a period of time. It is recognized that there may be a number of different empirical curve fits than those chosen in FIGS. 6-9 that produce essentially the same or similar effects on in situ alumina ore feed decisions.

If there is a significant difference between the rates of metal pad increase and anode carbon burn off, then each computed PV is corrected to a small degree to reflect a PV value for this differential. Nominally it is a small correction. For example, if the metal pad increase is 3.0 cm per day and the carbon burn off is 3.5 cm per day and the change in measured PV per cm of anode displacement is 300 millivolts, then the correction to the PV variable is based upon 150 mv/day, which is about 0.10 millivolts per minute (0.0017 mv/s), a small correction.

In an embodiment of the present invention, a data set was collected for an in situ bath alumina prediction:

Data set: measured PV time slope=5.16 mv/min and $PV_{average}$=4.298 v

Target % alumina=3.00.

Using the coefficients in FIG. 9, the in situ bath alumina prediction is 2.67%.

Using the coefficients in FIG. 8, $PV_{3.00\%}$=4.235 v, and $PV_{2.67\%}$=4.272 v, where $\Delta PV=PV_{target}-PV_{in\ situ}$=4.235 v−4.272 v=−0.037 v.

New $PV_{target}=PV_{average}+\Delta PV$=4.298 v−0.037 v=4.261 v

Alumina feed rates are now appropriately changed to achieve and maintain the targeted PV of 4.261 and in this manner maintain a % bath alumina level target of 3.00% within a small margin of error for a reasonable period of time that may extend several hours before a new in situ alumina prediction is desirable.

Using point feeders allows the alumina ore feed to be trimmed in small amounts to achieve a small amount of cycling about the targeted bath alumina set point. Coupling Proportional Differential Integral (PID) control with in situ modeling allows optimal trimming of alumina ore feed to achieve and maintain a highly accurate in situ bath alumina level for an extended period under normal operation with no cell intrusions. A judicious choice of parameters for PID control is employed to periodically make changes to point feeder systems of alumina ore delivery (or more ideally the Comalco patented continuous alumina ore feeder, U.S. Pat. No. 5,476,574). Small changes to point feed or continuous feed rates preferably occur every 5 to 10 minutes or so as needed to maintain a targeted PV linked to the in situ alumina prediction. If alumina seeps into a cell whenever an anode movement breaks a seal, in situ logic preferably detects the overfed condition for this and any other reason (e.g. a manual intrusion not detected by the processor) that excess ore is being introduced into the cell. As a result, ore delivered by the point feeders is decreased by in situ logic in compensation for excess feeding of any kind If a point feed device begins delivering decreasing amounts of alumina for any reason, then in situ logic preferably detects decreasing bath alumina levels and requests more frequent alumina feeding in compensation. Batch feeders (e.g. crust-type breakers) are more problematic since it is necessary to feed a cell in large amounts when the alumina level is judged not far above the anode effect level. A targeted bath alumina level of approximately 2.0% or so could be chosen to produce a batch feed command, when the PV time slope predicts a low level of alumina such as 2.00%. Ideally, the patented Comalco continuous ore feed method previously mentioned would be expected to work very well with in situ alumina feed control and are most preferred for use in the present invention. It is also possible that the performance of the experimental drained cathode cell (DCC) may be sufficiently enhanced by the utilization of in situ ore feed logic to permit commercialization of the DCC. One of the major problems with the DCC is the deposition of insulating alumina type conglomerates on the carbon cathode surface.

Figure 10:
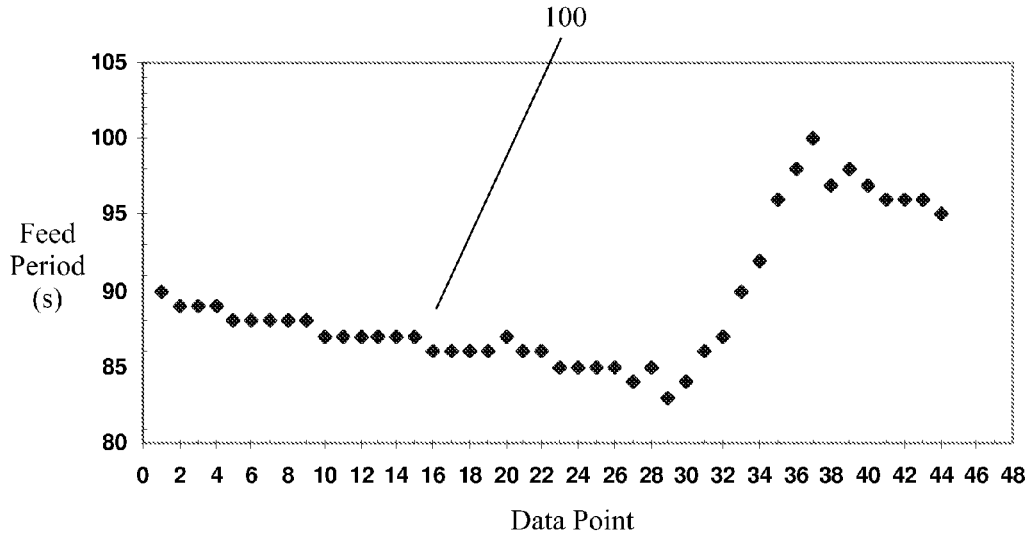
FIG. 10 shows a graph of simulated in situ point PID feed decisions made at various times to maintain a nearly constant bath alumina in an embodiment of the present invention.

FIG. 10 is a graph of simulated in situ point feed PID decisions (100) to the nearest second computed at each sampled data point in a data array covering several minutes. However, the change to feed period is not executed until the data array is filled with the last PID feed period being the one executed (95 seconds in this example), until the next data array is filled. The PID feed periods in FIG. 10 decrease initially because of decreasing bath alumina levels, after which the bath alumina level begins to increase slightly after data point 29 because of an earlier ore feed. At this time, computed PID feed periods start increasing because of increasing bath alumina levels. This type of feed cycling is typical of point feeding and maintains alumina bath levels without excursions into unacceptably high or low bath alumina levels, as present control strategies dictate. If continuous feeding methods are alternatively used, then the plot in FIG. 10 becomes much flatter (smaller effects from hysteresis since it is a recognized phenomenon that there is often a time delay between when fresh ore is introduced into the bath and when pot voltage changes from the dissolving ore charge are detected).

In situ ore feed control does not interfere with voltage optimization control. Whenever a pot needs a corrective increase or decrease in voltage, the in situ feed control targeted PV is easily adjusted to accommodate a pot voltage change. An anode adjustment produces a change in PV, and this change is added or subtracted to the old PV to allow in situ alumina control to continue, since a short time period is necessary for an anode adjustment to occur and then stabilize. During this short time period (possibly seconds), alumina levels do not change significantly. An in situ ore level routine for a new bath alumina prediction may be called upon, if, after several hours, multiple anode adjustments have been made, or a cell intrusion such as metal tapping, carbon setting, or manual intervention takes place.

Description and Applications of In Situ Bath Temperature Predictions

Additionally, the PV variable provides an accurate means to measure in situ bath temperature. When an anode/cathode gap adjustment is made, the measured change in PV is mostly sensitive to bath temperature. Predicting a cell's bath temperature using PR is not accurate since its large variance does not produce a statistically meaningful difference in PR between the before and after anode adjustment. The much more noise-free PV calculation makes it possible for the difference to be meaningful and highly predictive of bath temperature.

The change in a cell's PV value when an anode is adjusted is dependent upon the change in ohmic resistivity of the bath, which is approximately linearly dependent upon the anode/cathode distance at a given temperature. The distance-normalized PV (ΔPV in volts/cm) is a function of inverse absolute temperature (T) where $\Delta PV=a(1/T)+b$, where a and b are empirically derived coefficients. In this short time period when the anode position is changed a sufficient amount, no significant bath composition changes are taking place that jeopardize the in situ temperature prediction. The change in the distance-normalized PV (ΔPV) is mostly sensitive to the ohmic bath resistance component, which is dependent upon bath temperature for a given anode displacement. Other components of bath voltage do not change significantly when an anode is repositioned. The magnitude of change in PV per unit distance is needed to calculate the in situ bath temperature. This means that for any anode displacement the anode/cathode distance change needs to be accurately estimated or actually measured.

Figure 11:
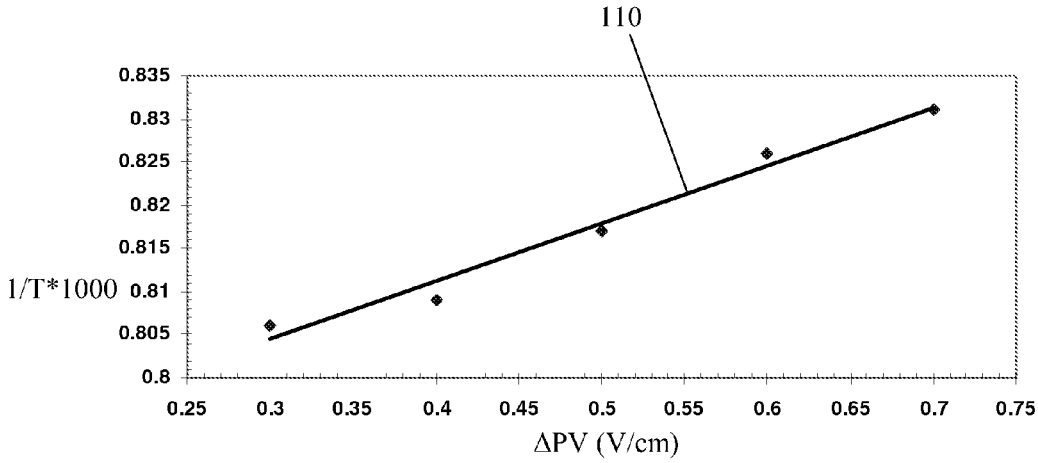
FIG. 11 shows the graphical relationship between $\Delta$PV and bath temperature in an embodiment of the present invention.

In an embodiment of the present invention, the relationship between ΔPV and temperature is shown in FIG. 11, which is only one of several plot types that may be used within the spirit of the present invention. Actual plots depend upon the cell type and other bath parameters. The data points in FIG. 11 are fit to a line (110) satisfying the equation:

$$1/(T\times 1000)=0.06700\times\Delta PV+0.7843.$$

When an upward anode adjustment of 0.183 cm produces a ΔPV of 0.097 v, then using the coefficients from the line of FIG. 11:

$$(1/T)\times 1000=0.0670\times(0.097/0.183)+0.7843=0.8198$$

T=1220 K (947° C.)

The ability to make multiple daily in situ bath temperature predictions on demand permits a greater degree of overall cell control. It is inarguable that infrequent manually measured bath temperatures are of limited usefulness (frequently manually taking bath temperatures is not operationally practical or always accurately performed). However, frequent and accurate in situ bath temperature measurements may be a significant component of potline control if they are linked to other cell operations. In an embodiment of the present invention, when a given metal tap operation removes more than the proper amount of metal from a given pot, then a prolonged high temperature excursion is likely to follow since the metal pad inventory is a key component of the pot's overall heat balance. Henceforth the next metal tap decision for that pot is guided by the in situ temperature profile developed since the last metal tap for that pot. Fluoride ($AlF_3$) addition decisions in order to maintain targeted bath ratios are a key element of overall potline control. This chemical addition may be greatly assisted if a credible temperature profile is available in conjunction with laboratory measured bath ratio analyses to determine if more or less than the normal addition of fluoride is needed. Coupling frequent in situ bath temperature predictions that are possible using the PV variable with additional historical potline information provides a more robust database that results in enhanced potline control. Maintenance of an optimal thermal balance is aided immensely by monitoring on demand in situ bath temperatures on a frequent daily basis. In situ cell control provides an enhanced potline toolkit.

An upward anode repositioning may be the better choice to calculate an in situ bath temperature level since a uniform distance for a given processor command is required on a consistent basis. Anodes may "coast" variable distances upon a downward command, unless there are reliable brakes that prevent anode coasting. If needed, an automated devise to accurately measure the distance for any given anode displacement would effectively address this issue. The coefficients of the empirical plot, such as those obtained from the data of FIG. 11, are used for in situ temperature predictions, however the actual coefficients depend on cell type and other operational parameters.

Allowing a control processor or computer to make multiple measurements of in situ bath temperatures on demand is a powerful methodology for optimizing pot performance such as metal tap decisions, bath ratio control, and voltage control. A cell's in situ temperature profile may be employed to help control the bath chemical composition (commonly referred to as bath ratio, which is the mass of NaF to mass of $AlF_3$). Each cell is different in some measure from another cell and it is conceivable to have a different appropriate bath ratio target for each cell using control with the PV variable. In situ control may establish with confidence an optimal bath ratio range for a given cell. Cell operation at lower temperatures and bath ratios is preferred to promote greater cell productivity. It is recognized that the bath alumina solubility window narrows when bath temperatures and bath ratios decrease. However, since in situ logic avoids cathode mucking episodes, lower temperatures and bath ratios are an achievable practical goal of great significance. Low bath ratios are preferably considered, since in situ alumina feed control based upon the PV variable checks the possibility of over feeding alumina ore to the cell. Continuous ore feed control is logically the ideal choice for lowering bath ratios for those cells that demonstrate their capacity to operate at low bath ratio levels that are presently considered unwise or simply not possible. In situ bath temperature predictions may be employed as a new and powerful control tool.

Description and Applications of In Situ Noise Levels Using the Lomb Algorithm

Outlined below is one of several statistical methods whereby PV computations can be employed to measure a cell's in situ noise level. Methods used for the less accurate pseudo-resistance variable (PR) produce variances that reflect not only a cell's true noise, but also a large measure of mathematically self-induced variance or noise, which obscures much of the vital information on what a cell may actually be experiencing. If a cell is judged to be too "noisy" for the correct reasons, then decisions based on PV variance may be made to increase pot voltage on a more statistically sound basis. A PV in situ derived noise level judged excessive may very well necessitate an increase in cell voltage during PV control. If a cell is judged stable because of relatively small noise levels reflective of little or no voltage cycling, then pot voltage may be cautiously trimmed to optimize energy consumption with PV control (the risk that a smaller anode/cathode gap does not increase metal re-oxidation is judged acceptable in this case). Noise levels associated with overvoltage changes are not causes for changes in pot voltage, but rather appropriate changes to alumina ore feed rate. However, when a voltage decrease decision is also monitored by in situ temperature measurements that follow voltage decreases, the risk to decrease pot voltage works in tandem with in situ bath temperature measurements.

The variance in a PV data array covering a span of about several minutes or so is the primary tool used to calculate PV noise levels (inverse of SNR ratio previously defined):

$$PV\,\text{noise}=\sigma^2/\mu \tag{7}$$

where $\sigma^2$=the variance, $\sigma$=the standard deviation, and $\mu$=the mean of PV in the data array It is also possible to use the standard deviation ($\sigma=\sqrt{(\text{variance})}$) or other related methods such as coefficient of variation to define in some way a PV-derived in situ noise value. In any case, a statistically significant difference in small changes of noise levels using the PV variable produces information which is useful for making appropriate decisions in a timely manner to control pot voltage levels. The much more intrinsically-high noise level of the PR variable does not have the same degree of sensitivity since a large measure of the variance is mathematically self-induced and may very well not be reflective of actual conditions. As a practical matter the variance to the average PV noise ratio ($\sigma^2/\mu$) may be multiplied by an arbitrary constant to produce values of noise levels which may be more easily understood and readily accepted by potline operating personnel.

The total PV noise level may be separated or deconvoluted into component parts: total noise (TN), total noise less frequency corrected noise (TNF), and total noise less frequency corrected noise less linear change in PV due to over-voltage changes (TNFO). TNFO can then be considered as pseudo-white noise. This frequency correction scheme to produce different noise levels in a PV data array involves a mathematical procedure that first uses Lomb generated frequencies of interest in conjunction with an optimization routine that selects the phase angle and amplitude to produce the lowest noise level ($h(t)=A\sin(\phi+\omega t)$, where h(t) is the oscillating voltage component, A is amplitude, angular frequency $\omega=2\pi f$, f being the Lomb frequency and t the data sampling period). The first step involves performing Lomb signal processing on the total PV data array (PV should be first corrected for the difference between rates of metal pad increase and anode carbon burn off, if necessary, as described previously) to obtain the frequencies of statistical significance. The Lomb algorithm has the ability to compute statistical confidence levels, $P(>z)=1-(1-e^{-z})^M$, for any sampled frequency of a given power (z) where M is related to the dimension of the data array. By nature this feature is lacking in FFT methods. The Lomb algorithm (per point weighted basis) also contains a powerful feature that allows it to escape altogether aliasing errors that can occur with conventional FFT algorithms (per time interval weighted basis). The requirement for this Lomb feature to be operative is that there is sufficient randomness built into the data sampling rate, which is not a difficult task for a control processor or computer. However, if uniform sampling rates are used, then aliased frequencies appear in the Lomb periodogram. In the deconvolution step the correct frequencies are determined by the one that produces the lower noise level. A selected level of confidence, P(z), may be chosen to reject the null hypothesis that a given frequency is simply background white noise. If statistically significant frequencies due to metal pad related rolling and/or oscillatory electrical shorting, etc. are detected, then the data array containing total noise (TN) is treated to remove the voltage cycling components (TNF) using any one of a number of algorithms for that purpose. This frequency corrected data array is then further processed to produce a time slope of PV by suitable mathematical means (linear regression is one method that is both simple and useful). The time slope may also be used to compute bath alumina levels when needed for in situ feed control decisions. The data array (TNF) may be further corrected to remove changes in PV due to bath alumina changes. This remaining corrected data array (TNFO) should now reflect pseudo-white noise, which is indicative of pot stability/instability that is not related to either metal pad rolling/oscillatory electrical shorts or rate of change of overvoltage. This residual pseudo-white noise varies from pot to pot. If a pot has a seemingly relatively high total noise, it may be that it is not caused from oscillatory voltage fluctuations and/or overvoltage changes, rather it may just have a high pseudo-white noise only and a voltage decrease may even be warranted on the basis of no detectable voltage oscillations. Likewise, a pot with a seemingly relatively low total noise may still have undesirable voltage fluctuations which demand a voltage increase. Lomb analysis is a superb tool for detecting credible (no aliasing) oscillating voltages that may often be corrected by anode adjustments. Optimal voltage control may be addressed by the means presented herein with an attendant decrease in the risk of squeezing the anode/cathode gap to levels that promote pot instability. It is recognized that a plethora of filtering methods are available to deconvolute a PV data array.

Voltage variations due to formation and release of insulating anode gases that coalesce into larger gas bubbles such as $CO_2$ contribute to the total noise and can be referred to as "bubble" noise. If this phenomenon is cyclic in nature, then Lomb processing may detect the appropriate frequencies if they are significant. Bubble noise levels as such likely need no corrective action taken since it may very well be an unavoidable phenomenon not removed by available potline practices. Detectable cyclic voltage variations due to gas bubble formation and release may be indicative of problematic anode conditions. In this manner a diagnostic feature of Lomb processing may be employed.

Figure 12:
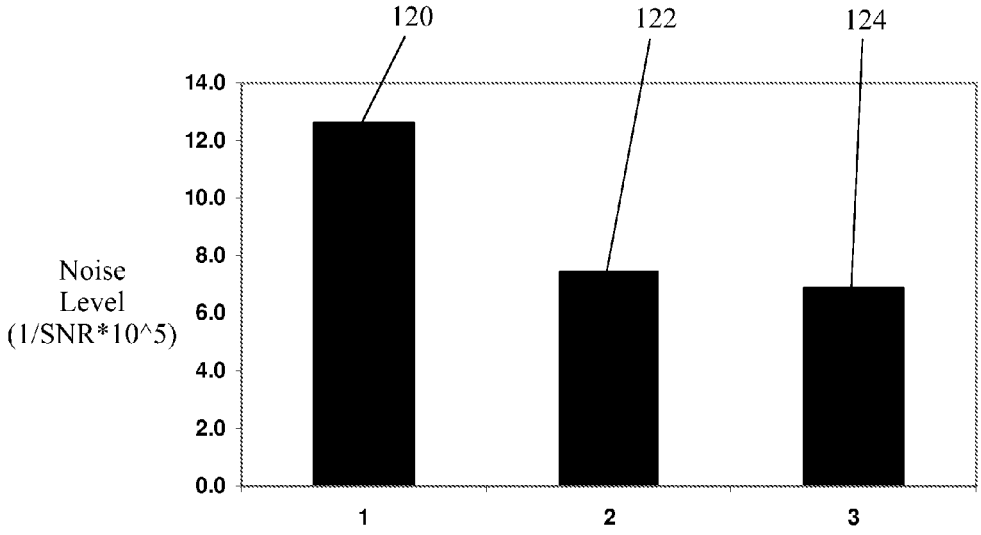
FIG. 12 shows the separation of noise components from a simulated data array of 300 data points having impressed random errors of ±0.10% on V and A, and a random value of I of 1.650±0.150 in an embodiment of the present invention.

FIG. 12 shows separating out noise components using a simulated data array of 300 points covering 5 minutes of data collection. Random errors of +/−0.10% on V and A were chosen as well as a random working value for I of 1.65±0.15. Voltage cycling and overvoltage increases were also impressed upon the data array.

The data set was deconvoluted using the Lomb algorithm, an optimization procedure to compute the amplitude and phase angle to detect voltage cycling, and a linear regression method to detect overvoltage changes. The pseudo-white noise (TNFO, 124) of FIG. 12 is 6.9 which should reflect mostly random noise of the deconvoluted data array. The noise level of 7.4 (TNF, 122) reflects both "white" noise and overvoltage changes, and the noise level of 12.6 (TN, 120) reflects the convoluted data array. The calculated pseudo-white noise level (TNFO) of 6.9 is nearly the same as the noise of the simulated data array that contained only the errors impressed upon V, A, and I. A scheme such as described is very helpful. A pot with relatively high white noise may not be reflective of metal pad instability and/or electrical shorting, including overvoltage changes due to alumina bath level changes, but rather unavoidable random ohmic fluctuations. Likewise, a low total noise level may mask real fluctuating metal pad/electrical shorting, whose threat to production efficiency needs to be addressed immediately. Lomb processing may be used to make improved in situ alumina predictions based upon separating different noise components from one another.

The PV variable is sensitive to undulations or roll of the liquid metal pad in the high magnetic fields of its environment. A cell's metal pad almost always has some degree of roll. What must be avoided is allowing higher than necessary metal pad roll. A large metal pad roll permits increased metal re-oxidation. Whenever a portion of the metal pad comes close to the anode surface, the rate of re-oxidation of metal increases with productivity suffering as a result. Lomb signal analysis using the PV variable is capable of detecting unacceptable metal pad roll and/or electrical shorting episodes that prompt immediate corrective action. The period of metal pad roll may be on the order of magnitude of many seconds and electrical shorting possibly significantly less time. There are occasions when a noisy pot does not have significant metal roll/electrical shorting. Cathode shell age is likely a factor related to this phenomenon, since it is well known that older pots are generally more noisy than newer pots at the same voltage. However, Lomb monitoring is easy to routinely perform and discriminates very effectively those frequencies typical of metal pad roll, oscillatory electrical shorting, or even possibly gas bubble type noise if it is cyclic in nature.

Whenever Lomb signal processing detects meaningful oscillations at frequencies characteristic of metal pad roll and/or electrical shorting, the data array may be corrected to remove the voltage oscillations in PV for the purposes of computing the time slope of PV used in predicting both in situ bath alumina and bath temperature. In this manner the predictive power of in situ bath alumina and temperature measurements is increased.

FIGS. 13-16 consist of graphs demonstrating how Lomb style signal analysis is used to verify metal pad oscillations and/or electrical shorting episodes using both PV and PR computations on a simulated data set in which two oscillatory modes of different frequencies were impressed on the data array of 300 points that contained ±0.10% errors in both V and A as well as using a randomized value of I=1.65±0.15 instead of the "true" value of 1.65. The impressed oscillatory components were 16 millivolts at a frequency of 0.0133 Hz and 10 millivolts at a frequency of 0.667 Hz (beyond the Nyquist critical frequency). For PV Lomb signal processing, two frequencies of great significance extremely close to the actual impressed frequencies of 0.0133 and 0.0250 do in fact appear above the statistically meaningless background. Equally reassuring is the fact that no aliasing errors occurred.

Figure 13:
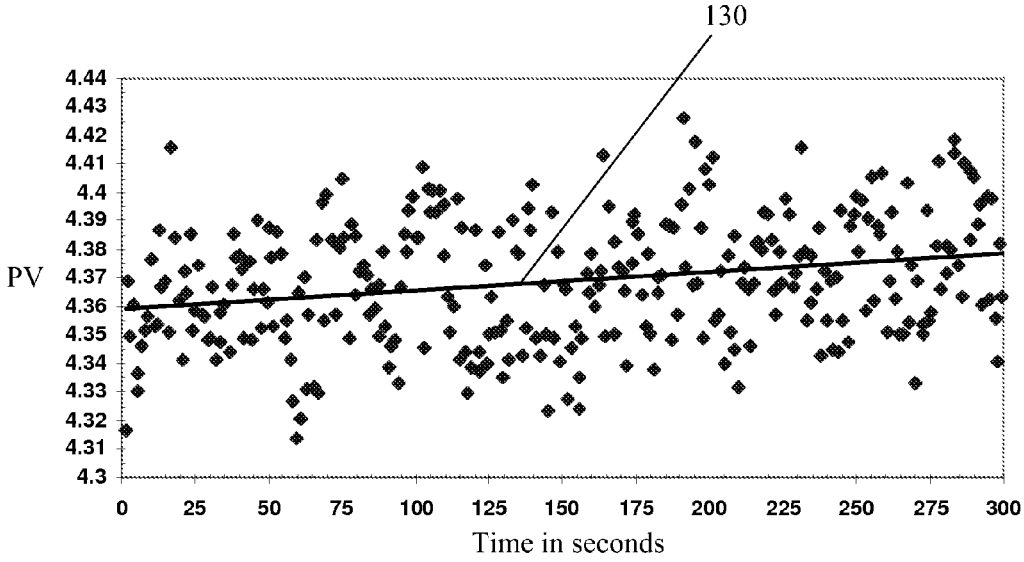
FIG. 13 shows a scatter plot of simulated potline PV data over time in an embodiment of the present invention.
Figure 14:
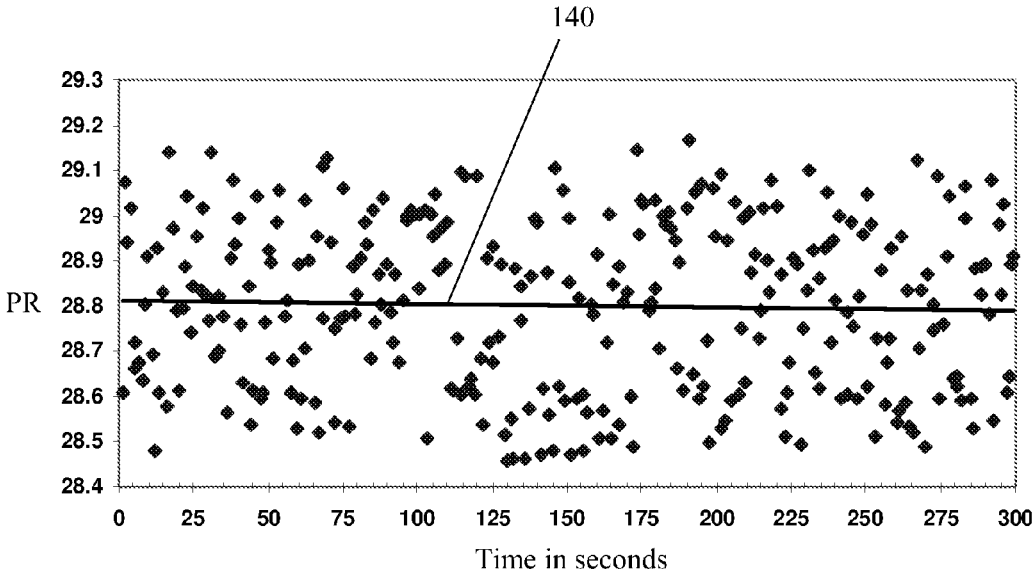
FIG. 14 shows a scatter plot of simulated potline PR data over time.

Inspection of the scatter plots in FIGS. 13 and 14 containing 300 data points each of uncorrected PV and PR values calculated using the same V and A raw data reveals a key difference. FIG. 13 shows the uncorrected PV variable plotted versus time with the line fit (130) satisfying the equation: uncorrected PV=0.00006355×time in seconds+4.3593, with a true slope of 0.0000667. FIG. 14 shows the uncorrected PR variable plotted versus time with the line fit (140) satisfying the equation: uncorrected PR=−0.00008019×time in seconds+28.813, with a true slope of 0.0000007223. Processing the data set produced a slope of 6.355E-05 for the PV variable and −8.019E-05 for the PR variable. The slope is used to calculate an in situ alumina level and must be positive in this case. The small relative difference between actual and measured slopes for PV (6.667E-05−6.355E-05) contrasts most significantly with that of PR which has a huge relative difference and a negative slope instead of a positive one. PR has no ability to predict a realistic in situ bath alumina under these conditions. It actually predicts an increasing bath alumina concentration when in fact it is decreasing in this case. However, the slope of the PV plot is highly useful for computing an acceptably accurate value of bath alumina. Using the coefficients of the graph in FIG. 9, the measured value of the PV slope converted to a predicted in situ bath alumina level of 2.79% is very close to the 2.77% level computed using the impressed slope of 4.00 mv/min that was imbedded in the simulated data set.

Figure 15:
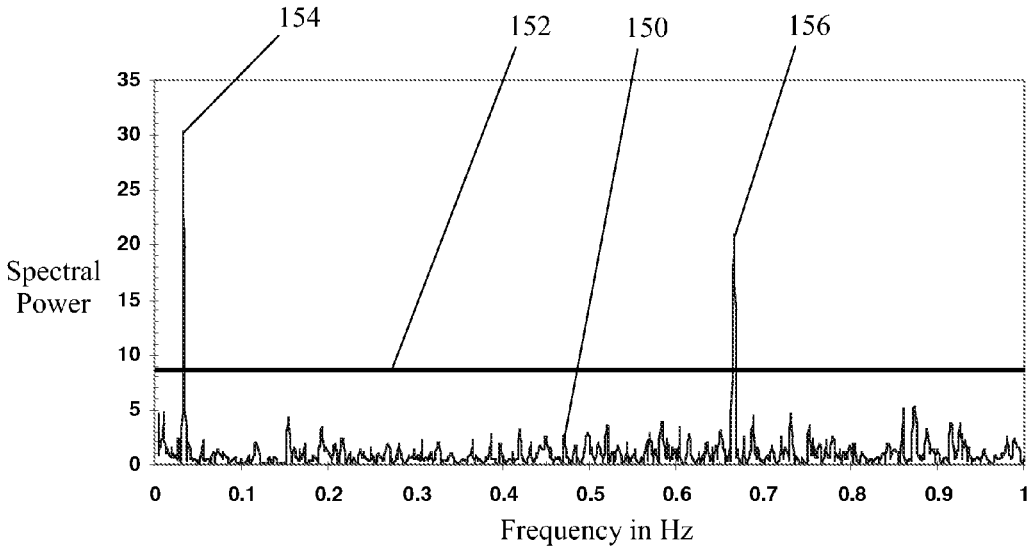
FIG. 15 shows the periodogram resulting from Lomb analysis of the data in FIG. 13 in an embodiment of the present invention.
Figure 16:
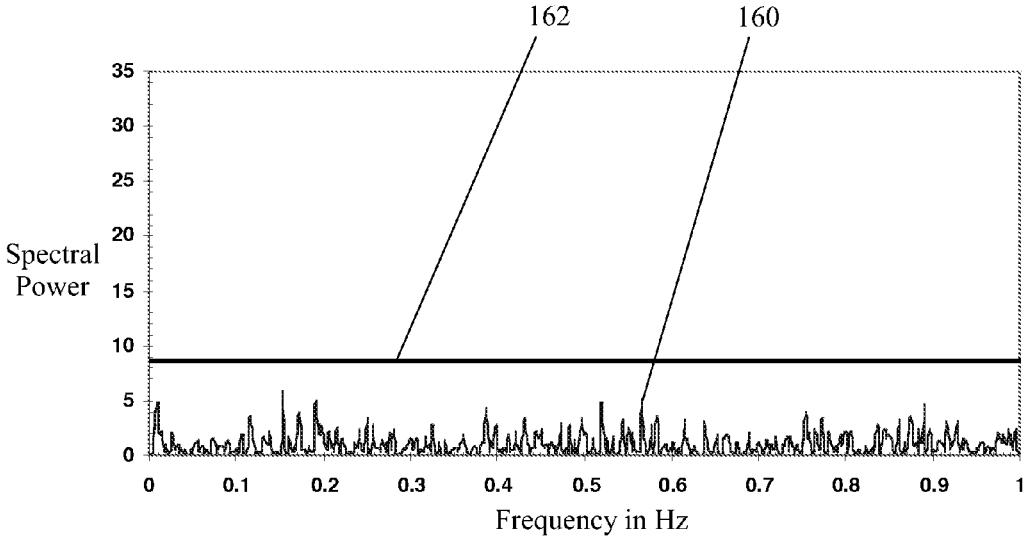
FIG. 16 shows the periodogram resulting from Lomb analysis of the data in FIG. 14 in an embodiment of the present invention.

Lomb periodograms of the data contained in FIGS. 13 and 14, as shown in FIGS. 15 and 16, of spectral power for PV (150) and PR (160) demonstrate again the superiority of PV over PR. The horizontal lines (152, 162) in FIGS. 15 and 16 represent P(>z)=0.10. The two impressed frequencies of 0.667 Hz (154) and 0.0333 Hz (156) were easily and accurately detected using PV and not at all using PR. The higher frequency PV signal (0.667 Hz) is the lower 10 my oscillation and the lower frequency PV signal (0.0333) is the higher 16 my oscillation. It is possible that extreme voltage cycling may be detected using PR, but lower voltage cycling, if not detected, can be detrimental to metal production.

To insure aliasing errors (errors resulting from sampling at a rate too slow for higher frequency components) do not occur, it is preferred to sample pot voltage and amperage at rates that reflect a degree of randomness. On average, the sampling rate preferably remains constant over the time of data collection (1 Hz in the simulated data array), but the actual time for a given sample would be, for example, t±randomized 0.500 seconds.

Care should be taken to choose a frequency detection method that prevents aliasing errors from occurring so action is not taken on the basis of a non-existent frequency. It is highly recommended that the Lomb algorithm be employed to avoid aliasing errors and to also provide levels of statistical significance for each frequency detected. Whenever Lomb processing of PV detects a frequency characteristic of unwanted metal pad rolling, electrical shorting, or possibly other voltage oscillations, then an appropriate anode upward adjustment may be made quickly to avoid an extended period of less than optimal metal production. Lomb signal processing offers a practical tool to improve both in situ bath alumina and in situ bath temperature predictions as well as detect undesirable voltage cycling, which is characteristic of a loss in metal production.

Trimming pot voltage is a goal of all cell control schemes. Energy efficiencies are expected to increase when this happens. However, the dangers of optimizing pot voltages to the lowest possible level is one long familiar to all experienced potline operators/supervisory personnel. Pot upsets can easily occur during an effort to lower pot voltages without the requisite tools to detect the moment an optimal voltage level has been achieved. To establish a targeted voltage set point based upon a pot's history is common practice at present. Also common is to allow a control processor to decrease pot voltage set points when noise levels suggest such action seems appropriate. A too common experience is that a lower voltage setting caused by decreasing the anode/cathode gap produces an unwanted pot upset of unacceptably long duration. Teasing a pot to lower voltages needs a reliably sensitive tool to detect immediately an incipient upset condition so that it is corrected immediately. Likewise maintaining a pot at a given voltage set point, when in fact it is so stable that easily several millivolts or more can be slowly trimmed without upset, is deleterious to energy efficiencies as well. In situ cell control reflects a new milestone for potline operations, since voltage trimming may be done with a statistically improved method to detect and correct upset conditions almost immediately. With PV control it is possible to un-tether a pot to allow it to seek its own optimal voltage setting and respond immediately to incipient upset conditions. Some pots may be so stable that lower voltages and bath ratios/temperatures may be targeted with PV control for ranges that seem too low by today's standards using PR control. Yet lower bath ratios that have tighter alumina solubility windows are achievable with in situ feed control that avoids over or under feeding alumina ore.

Figure 17:
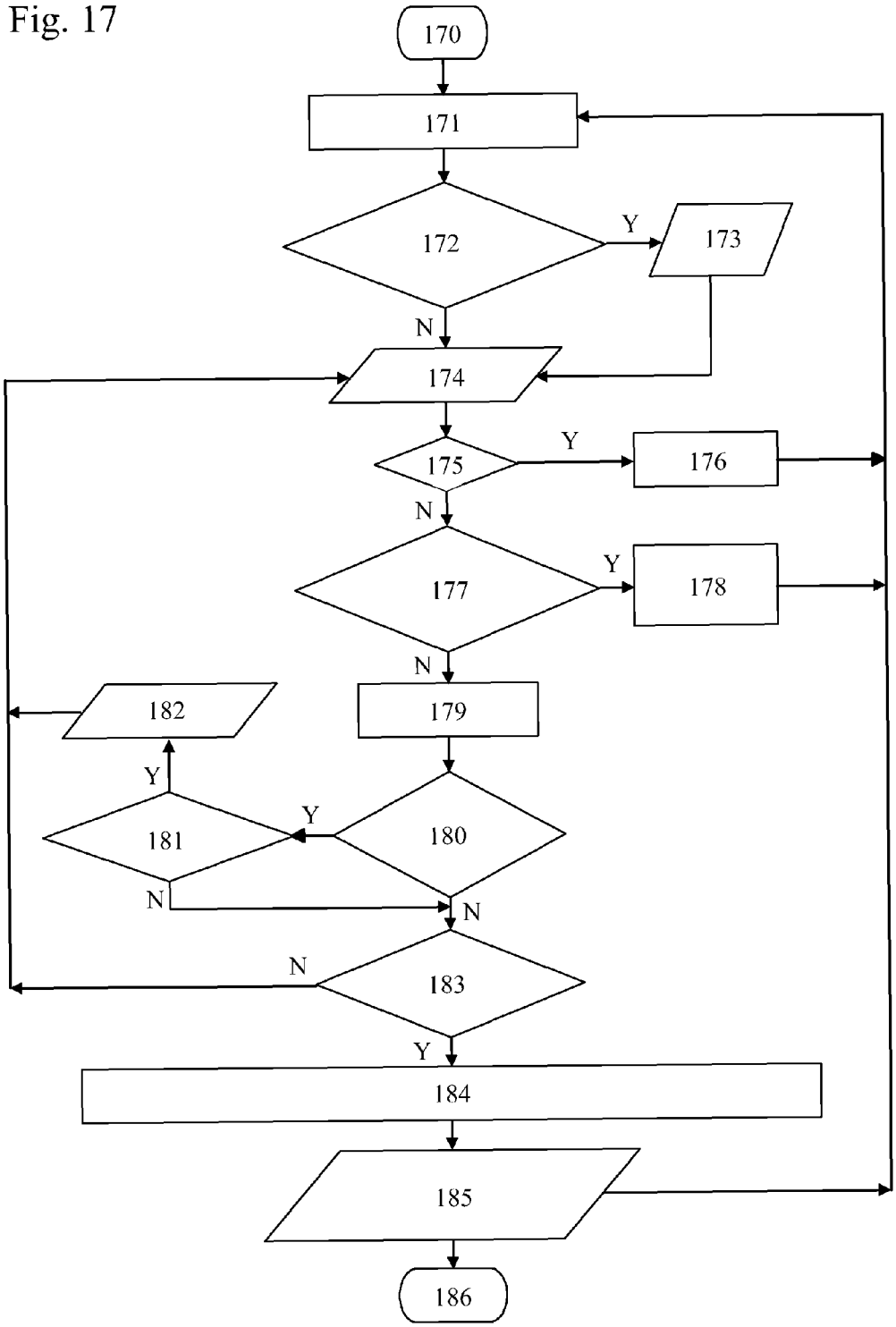
FIG. 17 shows a flowchart outlining a process control scheme using the PV variable in an embodiment of the present invention.

The flowchart of FIG. 17 outlines a data acquisition and process control scheme in an embodiment of the present invention based on the principles disclosed above. After the process starts (170), a data array is initialized with N=0 (171). The system then determines if an in situ alumina prediction is requested (172). If yes, the ore feed is turned off (173). If no, V and A data acquisition (174) is undertaken with the ore feed on. The value of V is then compared to the value of $V_{AE}$ (175). If V is greater than $V_{AE}$, then AE is suppressed (176) and a data array is initialized with N=0 (171). If not, the process determines whether the tap, set, or manual switch is on (177). If the switch is on, the system performs a tap routine or a set routine (178) and then goes back to initialize a data array (171). If the switch is not on, the system computes PV and N=N+1 (179). The system then determines whether there is an in situ temperature request (180). If there is, the system determines if the data array is half full (181). If the data array is half full, an anode adjustment occurs (182) and V and A data acquisition (174) is undertaken. If the data array is not half full, V and A data acquisition (174) is undertaken without an anode adjustment. If there is no in situ temperature request, the system determines whether or not the data array is full (183). If the data array is not full, V and A data acquisition (174) is undertaken. If the data array is full, PID feed rate, pot noise levels for anode adjustment, the in situ bath alumina level, or the in situ bath temperature is computed (184). The anode may be adjusted or the feed rate may be changed (185) based on the computed values. The process then may be ended (186), or to continue the process, a new data array is initialized (171).

The process starts with data acquisition of voltage/amperage signals for a cell sampled at rates chosen on the basis of the ability of the process computers or microprocessors employed in a potline. Data sampling rates any greater than 10 Hertz are typically not necessary. A rate of 1 Hertz may in fact be sufficient, but any lower rate is generally inadvisable. The period of metal pad roll can be more than 20 seconds and electrical shorting episodes may have periods of about several seconds or less (the voltage component due to gas "bubbles" may or may not be oscillatory in nature, but rather more of a random phenomenon). For this reason voltage/amperage sampling rates should be carefully tested for meaningful frequencies to determine the ideal data sampling rate. If a cell goes on anode effect during operation, then cell control is immediately taken over by the anode effect suppression routine, after which an in situ bath alumina request is made. When a cell's in situ bath alumina level needs to be remeasured, it is essential that the alumina feed be turned off briefly and anode movement prevented during the collection of sufficient data. If a switch is turned on for the duration of metal tapping, carbon anode setting, or manual intrusion events by pot operators, then no data is processed for in situ purposes. Whenever these switches are turned on, the alumina ore feed rate is maintained at its most recent level or kept at a nominal steady state rate until the pot is returned to computer control.

Once the data array is filled, then computations are preferably made to:

1. Compute a PID feed rate change based upon the in situ bath alumina prediction linked to the target PV. Each data point in the array has a PID computation, but no actual feed rate change is executed until the data array is full with the last data point's PID ore feed decision being the one acted upon to change point feed rate or continuous feed rate. Batch feed decisions are based upon an appropriate PV time slope that detects a low in situ bath alumina level.

2. Compute a new in situ bath alumina level if requested. A new PV target is computed based upon the difference in the target alumina level and the measured in situ level.
3. Apply Lomb signal processing to the data array. Compute the 3 noise components. If Lomb signal processing detects significant voltage oscillations, then an upward anode adjustment may be made to eliminate metal pad roll and/or electrical shorting. The Lomb-corrected data array is processed to produce a time slope of PV used to compute a new in situ bath alumina level if requested. Pot voltage may be cautiously decreased if the components of noise analysis warrant such action. Pot voltage should be increased whenever there is detectable metal pad roll and/or electrical shorting.
4. Compute in situ bath temperature measurement upon request. If voltage trimming has produced a significant increase in bath temperature predictions, then it may be necessary to increase cell voltage. If voltage trimming has produced a lower temperature, then it is possible to cautiously continue lowering cell temperatures. Accordingly, the bath ratio target is adjusted to reflect a cell's ability to operate at a more highly productive lower temperature, because accurate in situ alumina bath levels have been made.

Creative schemes utilizing the ideas contained herein may be designed to achieve another meaningful step to both improve metal production efficiencies and lower environmental emissions.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of process control for a Hall-Héroult process of aluminum production from alumina ore in an industrial potline, the method comprising the steps of:

a) measuring an array of sampled potline data comprising a plurality of cell voltages (V) and a plurality of line amperages (A) at a plurality of time points;
b) calculating a predicted voltage (PV) for each cell voltage and line amperage in the array;
c) controlling alumina ore feed rates and pot voltage settings based upon the predicted voltages;
d) calculating bath temperatures based upon the predicted voltages; and
e) calculating noise levels in each array from the predicted voltages to control pot voltage targets.

2. The method of claim 1, wherein the predicted voltage satisfies the equation:

$$PV=[(V-I)/A]\times RLA+I;$$

where I is an extrapolated cell voltage at zero amps; and RLA is a constant reference line amperage.

3. The method of claim 1, wherein the constant reference line amperage is an average operating line amperage.

4. The method of claim 1 further comprising the step of using a proportional differential integral control algorithm to regulate alumina ore feed rates to maintain a target PV value linked to a target alumina level.

5. The method of claim 1 further comprising the step of calculating an in situ alumina concentration comprising the substeps of:

a) stopping an alumina ore feed;
b) preventing an anode movement;
c) measuring the plurality of cell voltages and the plurality of line amperages for a plurality of time points after the alumina ore feed is stopped and the anode movement is prevented;
d) calculating a PV value at each sampled time point;
e) determining a mathematical slope relationship between the PV value and time; and
f) using a calibration between alumina concentration and time slope of PV to calculate the alumina concentration.

6. The method of claim 1, wherein the cell voltages and the line amperages are sampled at a rate between about 1 Hertz and about 10 Hertz.

7. The method of claim 1, wherein a rate of sampling the cell voltages and the line amperages is randomized to prevent aliasing errors in calculating noise levels.

8. The method of claim 1 further comprising the step of calculating a total noise (TN) less frequency corrected noise (TNF) less linear change in PV due to over-voltage changes (TNFO) from the array of potline data.

9. The method of claim 8, wherein the step of calculating the TNF utilizes a Lomb analysis.

10. The method of claim 8 further comprising the step of increasing an anode-cathode gap when a voltage cycling component of TN is greater than a pre-determined value.

11. The method of claim 8 further comprising the step of decreasing an anode-cathode gap when a voltage cycling component of TN is less than a predetermined value.

12. The method of claim 1, wherein the step of calculating bath temperatures based upon the predicted voltages comprises calculating an in situ bath temperature comprising the substeps of:

a) calculating a first PV value at a first time just prior to an anode-cathode gap adjustment;
b) adjusting an anode-cathode gap a predetermined distance to provide the anode-cathode gap adjustment;
c) calculating a second PV value at a second time just after the anode-cathode gap adjustment; and
d) using a calibration between bath temperature and change in PV as a result of the anode-cathode gap adjustment to calculate the bath temperature.

13. The method of claim 12 further comprising the step of employing recent bath temperature history to aid metal tap decisions based on the bath temperature.

14. The method of claim 12 further comprising the step of employing recent bath temperature history to aid in control of bath ratio.

* * * * *